US007400121B2

(12) United States Patent
Martins

(10) Patent No.: US 7,400,121 B2
(45) Date of Patent: Jul. 15, 2008

(54) SOFT-START SYSTEM FOR VOLTAGE REGULATOR AND METHOD OF IMPLEMENTING SOFT-START

(75) Inventor: Marcus Marchesi Martins, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1581 days.

(21) Appl. No.: 10/213,557

(22) Filed: Aug. 6, 2002

(65) Prior Publication Data

US 2004/0027106 A1 Feb. 12, 2004

(51) Int. Cl.
*G05F 1/44* (2006.01)

(52) U.S. Cl. ..... 323/274; 323/269

(58) Field of Classification Search ..... 323/282, 323/283, 284, 286, 288, 274, 275, 281, 272, 323/273, 276, 269, 278; 327/538, 539, 540, 327/143; 363/49, 143, 16, 89, 53
See application file for complete search history.

(56) References Cited

U.S. PATENT DOCUMENTS 4,543,522 A * 9/1985 Moreau ..... 323/303
4,779,037 A * 10/1988 LoCascio ..... 323/275
5,280,233 A * 1/1994 Poletto et al. ..... 323/269
5,677,617 A * 10/1997 Tokai et al. ..... 323/222
5,861,737 A 1/1999 Goerke et al.
6,040,639 A * 3/2000 Ginell et al. ..... 307/44
6,121,760 A 9/2000 Marshall et al.
6,175,223 B1 * 1/2001 Martinez et al. ..... 323/274
6,188,210 B1 2/2001 Tichauer et al.
6,348,833 B1 2/2002 Tsujimoto et al.
6,559,623 B1 * 5/2003 Pardoen ..... 323/274

* cited by examiner

*Primary Examiner*—Rajnikant B Patel
(74) *Attorney, Agent, or Firm*—Tum Thach; Wade J. Brady, III; Frederick J. Telecky, Jr.

(57) ABSTRACT

A system and method to provide a slow start up voltage, such as that can slowly ramp up or down by cyclically coupling a pair of associated energy storage devices, such as capacitors, during a start-up phase. The cyclic coupling of the capacitors, in conjunction with causing a change in charge associated with a first of the storage devices, results in incremental changes in the energy of the second energy storage device over a plurality of cycles. The energy associated with the second storage device can be used to control output circuitry that provides a desired ramp output signal.

27 Claims, 6 Drawing Sheets

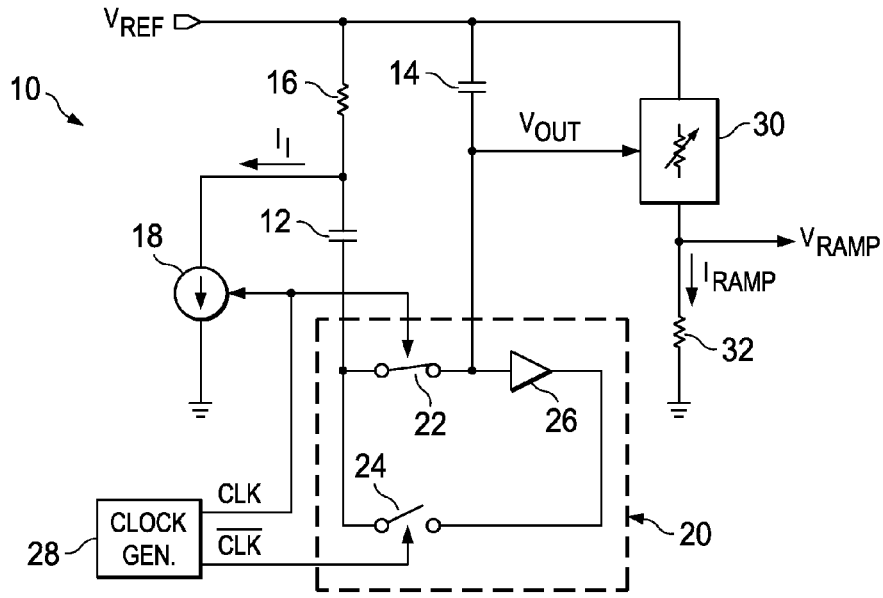
FIG. 1
FIG. 2
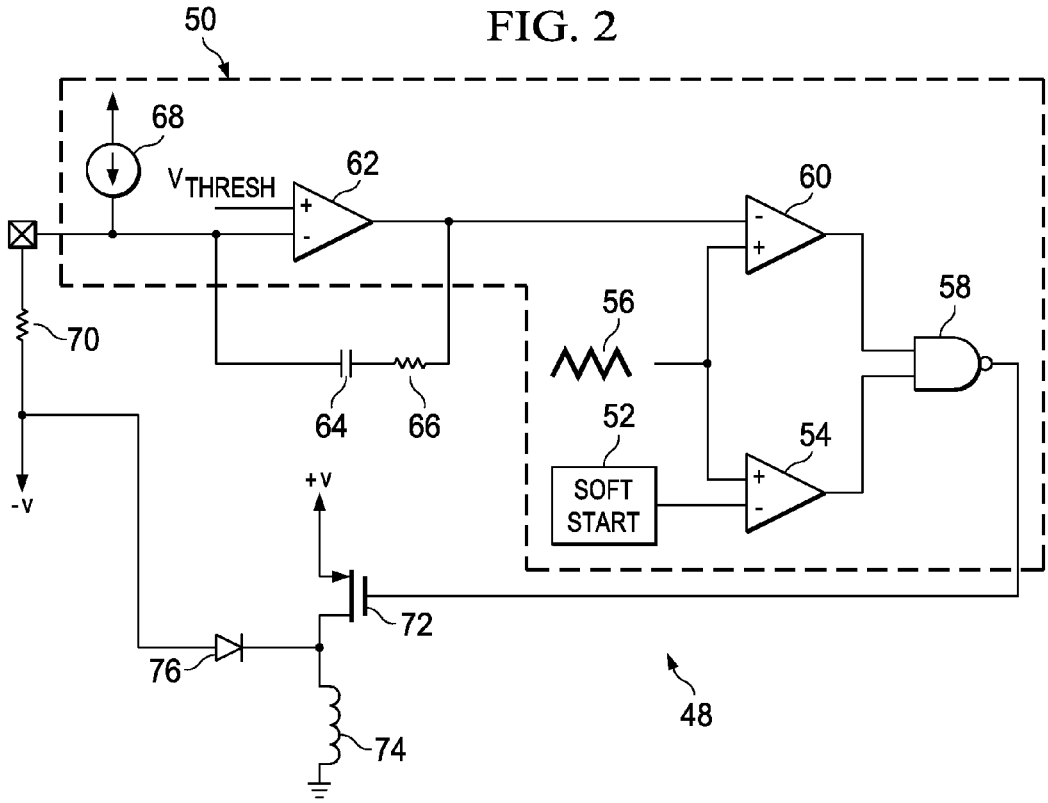

SOFT-START SYSTEM FOR VOLTAGE REGULATOR AND METHOD OF IMPLEMENTING SOFT-START

TECHNICAL FIELD

The present invention relates to electrical circuits and, more particularly, to power supply regulation of electronic systems.

BACKGROUND OF INVENTION

A variety of voltage regulators have been developed to provide supply voltages to digital and analog electronic systems with desirable tolerances. Typically, high performance digital electronic systems for computer, communication and industrial applications include many integrated circuits (e.g., microprocessors, digital signal processors, driver circuits, memory, etc.). The processing power, clock frequency, size and power consumption of such semiconductor devices are continually increasing. Corresponding improvements and more precise control of input voltage and current are usually needed to achieve desired improvements in performance of such semiconductor devices.

To control input voltages, an integrated circuit (IC) employs a voltage regulator to maintain a desired constant input voltage at the input to the IC. In addition to maintaining a substantially constant input voltage during normal (e.g., steady-state) operation of the IC, the electrical characteristics during start-up of the circuitry also can affect integrity and performance of the IC. Accordingly, dual mode voltage regulators have been developed in an effort to improve performance characteristics during start-up and normal operation.

A dual mode voltage regulator can operate in a start-up mode and in a normal mode. In the start-up mode, circuitry is provided to slowly ramp up (or down) to a desired input voltage in an effort to avoid overshoot that otherwise might occur. For example, one type of dual-mode voltage regulator uses current sources to charge an associated capacitor to a desired voltage for associated IC circuitry over a brief period of time, called a start-up phase. After completion of the start-up phase, the voltage regulator operates in a normal operating mode in which it provides a second fixed voltage (the operational voltage of the IC) on the input to the IC.

Unfortunately, the performance of prior art voltage regulators, including dual-mode voltage regulators, can often be unsatisfactory and thus suffer undesirable effects. For example, even small sudden changes in the input voltage can inject noise into the IC circuitry. In addition, though dual-mode voltage regulators reduce the damage caused by placing an operational voltage source directly on an IC circuitry, over-voltage conditions (e.g., spikes) may still occur. However, conventional dual-mode voltage regulators implemented in the IC tend to occupy a relatively large amount of IC wafer space. Existing dual-mode solutions that require circuitry external to the IC usually require an extra pin to electrically couple the external circuitry with the IC. Such external compensation systems further may require a large compensation capacitor to reduce slew rate, which increases the cost of the resulting circuitry.

SUMMARY OF INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates generally to a system and method to provide a slow ramp signal, such as a ramp up or ramp down signal. The slow start up is achieved by cyclically coupling first and second energy storage devices, such as capacitors. For example, the energy storage devices can be connected during a first part of a cycle so as to cause a change in a charge associated with the second storage device based on a redistribution of charge between the first and second storage devices. Then, during a next part of the cycle, the energy storage devices can be connected (e.g., by an amplifier) to pre-charge the first energy storage device. The coupling can be implemented, for example, by a switch network coupled between the energy storage devices.

By cyclically coupling and decoupling the energy storage devices in this manner, incremental (e.g., stepwise) changes can be provided in the charge (e.g., voltage) of the second energy storage device. The voltage associated with the second storage device can be used to control output circuitry that provides the desired slow ramp output signal based on the voltage of the second storage device. For example, the ramp output signal can incrementally ramp (up or down) between desired starting and final levels, such as to provide a soft (e.g., slow) start during a start-up phase of an associated regulator circuit.

In accordance with a particular aspect of the present invention, the energy storage devices correspond to a pump capacitor and a storage capacitor, and an incremental change in voltage occurs at the storage capacitor. The incremental change in voltage at the storage capacitor is facilitated by imposing a small voltage that is aggregated with the voltage of the pump capacitor during the first part of the cycle. The storage capacitor also can be utilized to pre-charge the pump capacitor during the second part of the cycle in accordance with an aspect of the present invention.

Through such an arrangement, a soft start voltage can be implemented in conjunction with a voltage regulator according to another aspect of the present invention. A voltage regulator implementing a soft-start, according to an aspect of the present invention, can reduce overshoot and control current output of the respective regulator. Additionally, the approach can be implemented in a single IC so as to reduce space requirements on the IC.

The following description and the annexed drawings set forth certain illustrative aspects of the invention. These aspects are indicative, however, of but a few of the various ways in which the principles of the invention may be employed. Other advantages and novel features of the invention will become apparent from the following detailed description of the invention when considered in conjunction with the drawings.

BRIEF DESCRIPTION OF THE DRAWINGS

FIG. 1 illustrates a schematic diagram of a soft start system in accordance with an aspect of the present invention.

FIG. 2 is a block diagram of a voltage regulator implementing a soft start system in accordance with an aspect of the present invention.

DETAILED DESCRIPTION OF THE INVENTION

Figure 3:
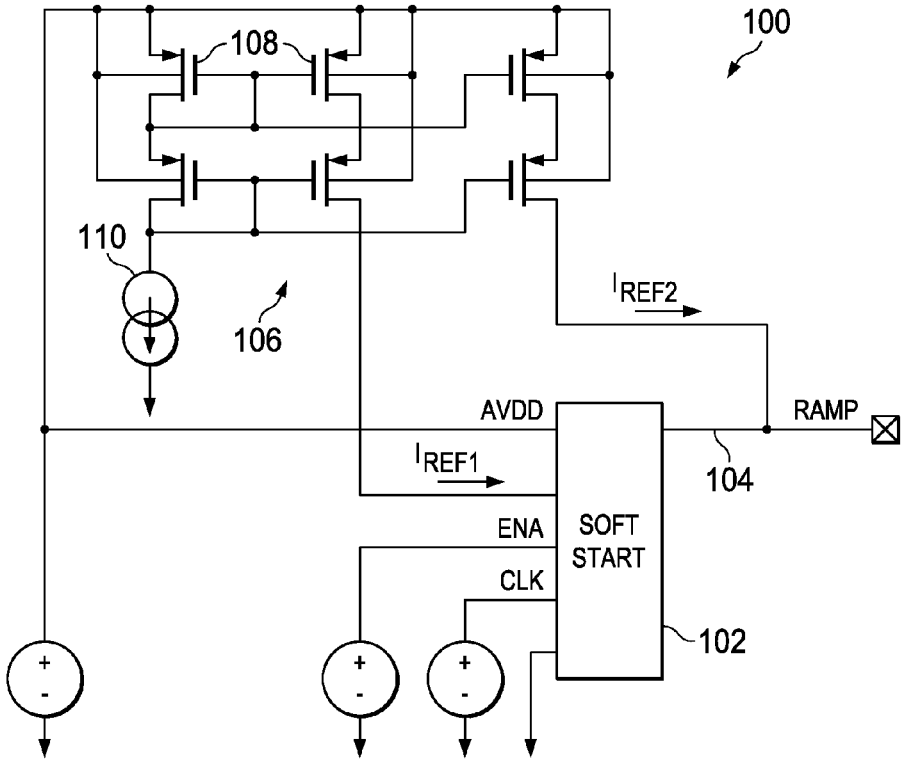
FIG. 3 is a schematic diagram illustrating an example of a soft start system implemented in accordance with an aspect of the present invention.

The present invention relates generally to a system and method to provide a slow start up voltage, such as that slowly ramps up or down. A desired slow start up voltage is achieved by cyclically coupling a pair of associated energy storage devices, such as capacitors, during a start-up phase. The cyclic coupling of the capacitors, in conjunction with causing a change in charge associated with a first of the storage devices, results in incremental (e.g., stepwise) changes in the energy of the second energy storage device over time. The energy associated with the second storage device can be used to control output circuitry that provides a desired ramp output signal. For example, the ramp output signal can incrementally ramp (up or down) between desired starting and final levels, such as to provide a soft (e.g., slow) start during a start-up phase of an associated regulator circuit.

FIG. 1 depicts an example of a soft start system 10 that could be implemented in accordance with an aspect of the present invention. The system 10 includes a pair of energy storage devices, which are illustrated as capacitors 12 and 14. The capacitor 12 is coupled to a reference voltage $V_{REF}$ through a resistor 16 and the capacitor 14 is coupled to $V_{REF}$ directly in the illustrated example. A current source 18 is coupled to the node intermediate the capacitor 12 and the resistor 16 to selectively provide current relative to the node. For example, the current source 18 draws a current 11 (e.g., fixed or variable over time) during a particular coupling between the capacitors 12 and 14, which causes a corresponding voltage drop across the resistor 16 proportional to the current I1 and the resistance of the resistor. Alternatively, current could be sourced to the node to provide another mode of operation for the system 10 according to an aspect of the present invention.

The capacitor 12 is coupled to the capacitor 14 through a switching system 20. The switching system 20 includes a pair of switches 22 and 24, which operate between open and closed conditions mutually exclusively to selectively connect the capacitors. The switch 22 interconnects the capacitors 12 and 14. The other switch 24 is connected in series with an isolation component 26, which series combination is coupled in parallel with the switch 22. The isolation component 26 electrically isolates current from the capacitor 14 to the capacitor 12 when the switch 24 is closed. For example, the isolation component 26 could be a unity gain amplifier (e.g., having a high input impedance) or other circuitry capable of providing desired current isolation. In this way, the amplifier provides a voltage substantially equal to that of capacitor 14 for pre-charging the capacitor 12 when the switch is closed.

By way of illustration, the switches 22 and 24 can be switched consecutively between ON and OFF conditions based on a clock signal, indicated at CLK. A clock generator 28 can generate the clock signal CLK. The CLK signal also can control the current source 18 to provide current I1 (e.g., I1 can be supplied when the CLK signal is high). To illustrate the mutually exclusive operation of the switches based on the CLK signal, in FIG. 1, the switch 22 and the current source are depicted as being biased by a CLK signal (to an on condition) and the switch 24 is shown as being biased by an inverted clock signal $\overline{CLK}$ (to an off condition). It is to be understood and appreciated that instead of inverting a control signal to control one of the switches, different types or configurations of switch devices could be employed to achieve desired cyclical functionality.

By way of further illustration, the voltage potential across the capacitor 12 and the resistor 16 is used to incrementally adjust the voltage across the capacitor 14 during a first part of the cycle. In particular, the voltage potential across the resistor 16 due to current I1 is added to the voltage of the capacitor 12 during this part of the cycle to provide an aggregate voltage (e.g., the voltage across the capacitor 12 plus the voltage across the resistor 16). Accordingly, the switch 22 electrically couples the capacitors 12 and 14 to generally redistribute the charge between the capacitors 12 and 14. Because the voltage on capacitor 12 is added to the voltage potential across the resistor 16, there will be a redistribution of charge when the capacitors 12 and 14 are coupled. This causes the voltage across capacitor 14 to increase in a generally stepwise manner with each cycle. The size of the steps are functionally related to a ratio of the respective capacitances of the capacitors 12 and 14 and the voltage potential generated by drawing I1 through the resistor 16.

During the next part of the cycle, the capacitor 14 pre-charges the capacitor 12 through the switching system 20. In particular, the isolation component 26 (e.g., operating as a unity gain amplifier) provides a voltage substantially equivalent to that of capacitor 14 to the capacitor 12 through the switching system 24 during this part of the cycle. Because no current 11 flows at this stage and because the capacitor 12 recently discharged some charge during the preceding part of the cycle, the voltage provided by the isolation component 26 (e.g., substantially equal to the voltage across the capacitor 14) exceeds the present voltage of the capacitor 12. Thus, the capacitor 12 is pre-charged to have a voltage substantially equal to that of the capacitor 14. With the next cycle, the sum of the voltage across the resistor 16 and the pre-charged voltage of the capacitor is used to increment the voltage across the capacitor 14 by closing the switch 22. As mentioned above, the process is repeated to incrementally increase the voltage across the capacitor 14, which results in a corresponding decrease in $V_{OUT}$.

The gradual increase in the voltage across the capacitor 14 (e.g., corresponding to a decrease in $V_{OUT}$) and pre-charging of the capacitor 12 further can be facilitated by implementing the capacitor 12 with a smaller capacitance than the capacitor 14 according to an aspect of the present invention. For example, the capacitor 12 can have a capacitance about 5-100 times smaller than capacitor 14, although other capacitance ratios could be utilized. It is to be appreciated that the arrangement in the system 10 enables a low ratio between capacitors, which should enable a small area to be occupied by the system implemented on an IC.

In order to provide a desired ramping output $V_{RAMP}$, the system 10 also includes a variable resistance device (e.g., a transistor or other circuitry) 30 for selectively providing a ramp output signal $V_{RAMP}$. Specifically, the device 30 is coupled to the capacitor 14 for receiving the $V_{out}$ control signal, which is equal to $V_{REF}$ minus the voltage across the capacitor 14. The output signal $V_{out}$ biases the device 30 to control the amount of current $I_{RAMP}$ across an output resistor 32 coupled between the device and ground, for example. The decrease in $V_{OUT}$ due to operation of the switching system 20, as described above, controls the device 30 to reduce the current $I_{RAMP}$, which provides a corresponding decrease in $V_{RAMP}$.

While the system 10 in FIG. 1 is generally depicted and described as providing a ramp down signal, those skilled in the art will understand and appreciate that a ramp up signal also could be implemented in accordance with an aspect of the present invention. For example, the $V_{REF}$ could be set to ground (or other low) potential with the current source 18 sourcing positive current relative to the juncture between the capacitor 12 and resistor 16 so as to add a corresponding voltage to the capacitor 12 with each cycle. The voltages across the capacitors would increase and $V_{OUT}$ would ramp up accordingly.

FIG. 2 depicts an example of a negative switching voltage regulator 48 that includes a controller 50 for implementing a soft start system 52 in accordance with an aspect of the present invention. The voltage regulator controller 50 can be implemented in a single integrated circuit (e.g., as indicated by dotted lines), although different parts could be implemented in different ICs.

The soft start system 52 provides a soft start output signal (e.g., a ramp down signal) to a comparator 54. Another input of the comparator 54 receives a triangular ramp signal 56. For example, the triangular signal 56 oscillates between about 1.3 volts and about 2.6 volts at a predetermined frequency. The comparator 54 thus compares the triangular ramp signal 56 relative to the ramp signal provided by the soft start system 52 and provides a corresponding output signal to an input of a NAND gate 58 based on the comparison. Thus, so long as the triangular ramp signal 56 exceeds the ramp signal from the soft start system 52, the comparator 54 provides a high output signal to the NAND gate 58.

The soft start system 52 is programmed and/or configured to provide a desired ramp signal (e.g., a ramp down signal) in accordance with an aspect of the present invention. For example, the ramp signal is generated by modifying a charge stored in a first charge storage device (e.g., a capacitor) and then redistributing the charge between the first and a second charge storage device (e.g., another capacitor having a greater capacitance). The second charge storage device is also used to pre-charge the first storage device before the next redistribution cycle. In this way, the second storage device experiences a slow change in its charge (e.g., an increase or decrease in charge) related to the change in charge of the first storage device. By modifying and redistributing the charge repeatedly over time, a slow ramp signal (e.g., that changes in a generally stepwise manner) can be generated according to an aspect of the present invention.

The triangular signal 56 also is provided to a non-inverting input of another comparator 60. The comparator 60 is coupled to receive an error signal at its inverting input from an error amplifier 62, and provides its output to the NAND gate 58. The error amplifier 62 receives a reference voltage $V_{THRESH}$ at a non-inverting input and a feedback signal from the regulator negative output at its inverting input. This feedback is provided by resistor 70 and current source 68. A compensation network is formed by capacitor 64 and resistor 66 coupled in series between the output and the inverting input of the error amplifier 62. The error amplifier 62 provides the error signal to the comparator 60 depending on the voltage at its inverting input relative to $V_{THRESH}$.

The NAND gate 58 is coupled to control a transistor (e.g., a PMOS) based on the respective outputs of the comparators 54 and 60. The transistor 72 is illustrated as being coupled to a positive voltage and to ground through an inductor 74. A diode 76 is coupled between the negative voltage potential and a juncture between the inductor 74 and transistor 72. The diode 76 provides a current path to charge an output capacitor (not shown, but usually located at the −V node) with a negative voltage, at a time during which the inductor 74 is flying back and transistor 72 is off. Thus, for the example of a PMOS transistor 72, the transistor is on when the output of the NAND gate is low, such that current flows through the transistor and inductor 74 from the positive voltage source. When the output of the NAND gate 58 goes high, the PMOS transistor 72 is off. It will be appreciated that when the soft start system 52 provides a ramp down signal, initially, the ramp down signal from the soft start system 52 is high and the comparator 54 controls the loop.

By way of illustration, the ramp down signal starts at about 3 volts (or greater), which exceeds the triangular signal 56. As a result, the comparator 54 provides a low output to the NAND gate 58, which forces the output of the NAND gate high, thereby turning off the PMOS transistor 72. It is to be appreciated that the output of the comparator 54 generally will alternate between high and low during the start up phase based on the relative values of the ramp signal and the triangle signal 56. As the ramp down signal from the soft start system decreases according to an aspect of the present invention (e.g., to a value near 1.56 volts), it will eventually be lower than the output of the error amplifier 62. At this stage, the other comparator 60 begins to control the duty cycle of the PMOS transistor 72. This is because the output of the comparator 60 goes to zero before the output of the comparator 54 goes to zero, and the output of the comparator 60 goes back high after the output of comparator 54 goes high.

It is thus to be appreciated that the system 50 thus begins it normal run operation according to the time that the soft start system takes to ramp from its starting voltage to its ending voltage. The soft start system 52 further provides a slow ramp as well as enables a smooth transition from the soft start operation to the normal run operation. In addition, the ramp signal provided by the soft start system 52 can control the duty cycle of the switching regulator. For example, if the ramp voltage exceeds the threshold provided by the triangle signal 56 (e.g., greater than 2.6 V) the duty cycle of the switching regulator is zero. If the ramp voltage is less than the threshold, the duty cycle varies according to the signal from the comparator 60.

FIG. 3 illustrates an example of a system 100 operative to provide a ramp signal in accordance with an aspect of the present invention. The system 100 includes a soft start block 102 operative to generate a desired RAMP signal (e.g., ramp up or ramp down) at its output 104 according to various input signals provided to the block. In the example of FIG. 3, a bias generator 106 is coupled to the soft start block 102 to provide an external biasing current $I_{REF1}$ that is used to implement the RAMP signal at 104. The bias generator 106, for example, includes an arrangement of current mirrors 108 coupled to a DC current source 110 that provides a biasing current. For example, the current source 110 provides a current of about 20 μA, which is mirrored to the input of the soft start block 102. The bias generator also provides another biasing current $I_{REF2}$ to the output 104, which enables the RAMP signal to plateau to a desired fixed level during the soft-start cycle. Alternatively, a fixed voltage source could supply a DC voltage to which the RAMP signal can ramp during the soft-start cycle: An enable (ENA) signal also controls operation of the soft start block 102. When enabled, the soft start block 102 implements the desired ramp incrementally (e.g., in steps) as a function of a clock pulse signal (CLK). For example, the CLK signal (or other timing pulses) can be employed to cycle internal components of the soft start block to cause a gradual ramp signal at 104 in accordance with an aspect of the present invention. Additional fixed voltages AVDD is provided to the soft start circuitry to provide power for implementing the desired ramping functionality. It further will be appreciated that the incremental steps at which the RAMP signal changes can vary throughout the soft start mode.

Figure 4:
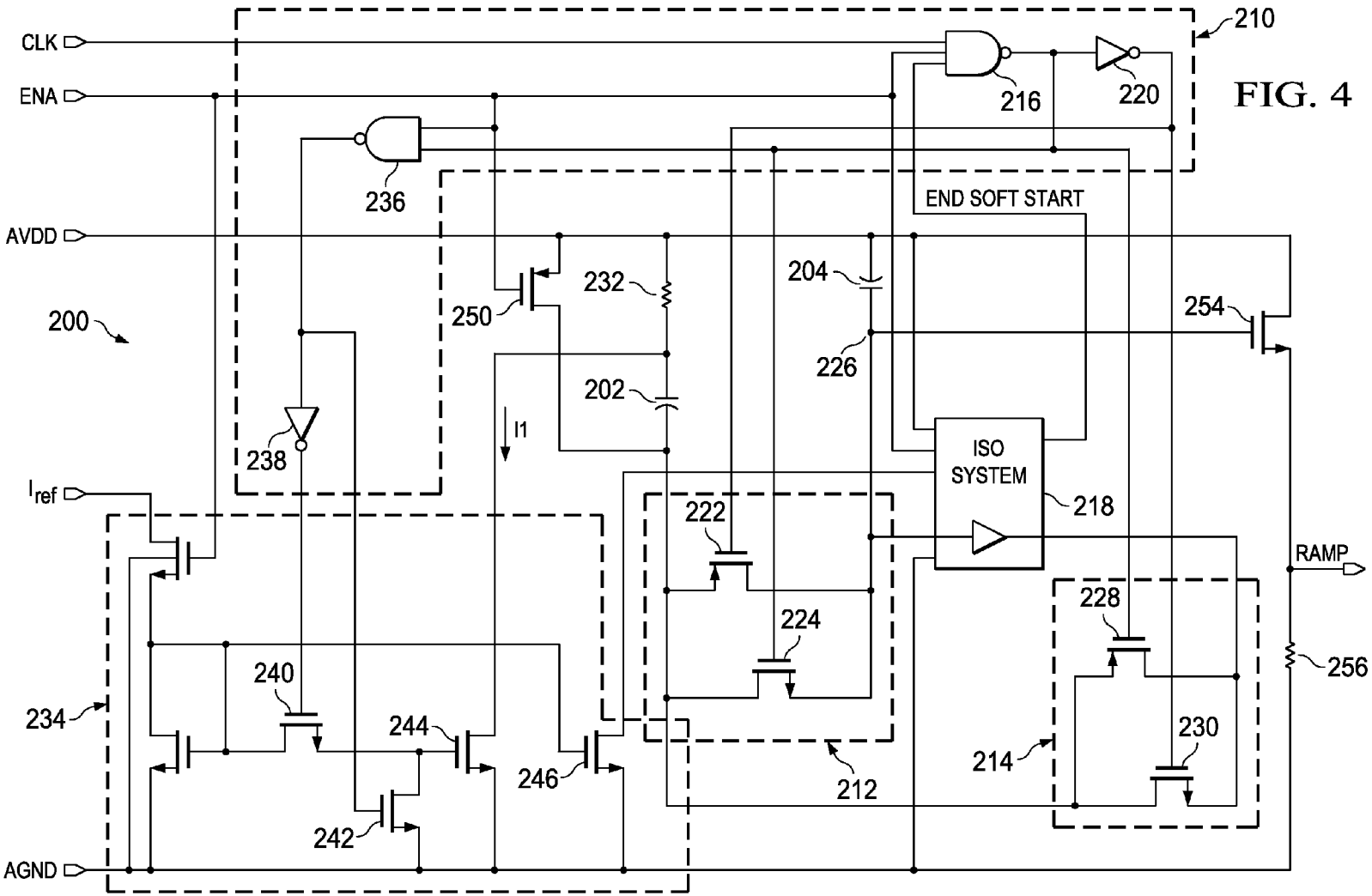
FIG. 4 is an example of a circuit configured to implement soft start circuitry in accordance with an aspect of the present invention, such as could be employed in the system of FIG. 3.

Turning now to FIG. 4, an example of soft start circuitry 200 configured to generate a ramp output signal (RAMP), in accordance with an aspect of the present invention, is illustrated. In general, the soft start circuitry 200 includes a pair of charge storage devices 202 and 204 (e.g., each including one or more capacitors) that are arranged to cooperate through associated circuitry for providing the desired slow ramp signal according to an aspect of the present invention. The storage devices 202 and 204 interact with each other so as to gradually charge from a starting voltage to an ending voltage by repeatedly changing charge in one of the storage devices and then redistributing the charge between the respective pair of storage devices so as to cause a corresponding change in the charge of other storage device. The RAMP signal also decreases as the charge of the storage device 204 increases, which results in a corresponding decrease in the voltage at 226. While the following example and the circuitry 200 will be described with respect to providing a ramp down RAMP signal, those skilled in the art will understand and appreciate that such a system also could be configured to provide a ramp up signal according to an aspect of the present invention.

The soft start circuitry 200 includes input logic 210 that controls the cycling of power within the circuitry. In this example, a clock signal (CLK) and an enable signal (ENA) are provided as inputs to the control logic 210, such as can be provided by other circuitry located in the same or a different IC. In general, the logic 210 is configured to control associated switch systems 212 and 214 so as to selectively connect and disconnect the storage devices 202 and 204 to generate the RAMP signal in accordance with an aspect of the present invention.

In the example of FIG. 4, the logic 210 includes a NAND gate 216 that receives as its inputs the CLK and ENA signals. Another input corresponds to an END SOFT START cycle signal provided by an isolation system 218, which is operative to terminate the soft-start cycle in appropriate circumstances. That is, the isolation system 218 also includes circuitry (see, e.g., FIG. 7) operative to detect the end of a soft start cycle to facilitate smooth transition from the start up mode to the normal mode. The NAND gate 216 provides its output to an inverter 220 as well as to other components, as described herein. In particular, the output of the NAND gate 216 and output of inverter 220 are provided to the switch systems 212 and 214 for electrically coupling the respective storage devices together based on the inputs to the NAND gate 216. In general, the switch systems 212 and 214 operate mutually exclusively based on their control inputs from the NAND gate 216 and inverter 220.

The switch system 212 is illustrated as a pair of transistors, namely a PMOSFET 222 and a NMOSFET 224, which are connected together in parallel between the capacitors 202 and 204. The transistor 222 receives as its input the output of the inverter 220 and the transistor 224 receives as its input the output of the NAND gate 216. In this way, the transistors 222 and 224 can operate concurrently to electrically couple the respective capacitors 202 and 204. A node 226 corresponding to a juncture between the respective transistors 222 and 224 and the capacitor 204 also is coupled to the isolation system 218 for providing an indication of the voltage across the capacitor 204.

The switch system 214 is similarly configured. In particular, it includes two transistors 228 and 230 connected in parallel between the capacitor 202 and an output of the isolation system 218. It is to be understood and appreciated that the isolation system 218 operates as an isolation amplifier having, for example, a unity gain, to enable the voltage of the capacitors 204 to be duplicated at the capacitor 202 while maintaining electrical current isolation between the capacitors. The transistor 228 is gated according to the output of the NAND gate 216 and the transistor 230 is gated by the output of the inverter 220. In this arrangement, the respective switch systems 212 and 214 operate mutually exclusively to enable redistribution of charge between the capacitors 202 and 204 in accordance with an aspect of the present invention.

As mentioned above, the capacitors 202 and 204 are electrically coupled to a fixed voltage supply, indicated at AVDD. In particular, the capacitor 202 is coupled to AVDD in series with a resistor 232. A juncture between the resistor 232 and the capacitor 202 is coupled to a current source system 234. The current source system 234 receives a reference current $I_{REF}$, such as a low DC current. The logic system 210 controls operation of the current system 234 via a NAND gate 236 that receives as inputs the ENA signal and the output of the NAND gate 216. The NAND gate 236 is coupled to an inverter 238. The inverter 238 inverts the output of the NAND gate 236 and provides its output to an input of an NMOS transistor 240 of the current system 234. The output of the NAND gate 236 is provided to another NMOS transistor 242 also of the current system 234.

The transistors 240 and 242 operate to control an arrangement of current mirrors within the current system 234 for mirroring desired current I1 relative to the node between the resistor 232 and capacitor 202. The transistor 240 is gated by the output of the inverter 238 and the transistor 242 is gated by the output of the NAND gate 236. The transistors 240 and 242 will cycle between their respective on/off and off/on conditions based on the CLK signal. Accordingly, when the transistors 240 is on (transistor 242 is off), the input current $I_{REF}$ is mirrored at transistor 244 as current I1, which, in turn, causes a voltage drop across the resistor 232 proportional to its resistance and the mirrored current. In contrast, when the transistor 242 is on (transistor 240 is off), the gate of the transistor 244 is pulled low, such that current I1 is not mirrored and no voltage drop is imposed across the resistor 232. The current system 234 also mirrors current at transistor 246 independently of the operation of the transistors 240 and 242, which mirrored current is provided to the isolation system 218 via the transistor 246.

By way of illustration, the capacitor 202 has a capacitance that is about an order of magnitude smaller than that of capacitor 204. For example, the capacitor 202 may be about 0.5 pF while the capacitor 204 is about 5 to 10 pF. This capacitance ratio between the capacitors 202 and 204 is useful to facilitate balancing (or redistributing) the charge between the capacitors according to an aspect of the present invention. Prior to initial application of current through the resistor 232, the ENA signal activates a transistor 250, thereby causing the voltage across both capacitors 202 and 204 to discharge completely. That is, the ENA signal directly causes the transistor to shunt the capacitor relative to AVDD. Similarly, in response to the ENA signal, the logic system 210 causes the switch system 212 to activate, thereby shunting the capacitor 204 relative to AVDD.

As mentioned above, switching systems 212 and 214 operate consecutively and mutually exclusively as a function of the clock signal CLK to cycle the soft start system. The cyclic operation of the system 200 results in capacitors 202 and 204 being connected to redistribute their charges between the capacitors, which causes a gradual increase in the charge associated with the capacitor 204. The current system 234, including transistors 240 and 244, also is activated during the part of the cycle when the switching system 212 connects the capacitor 202 to 226. Because current equal to about $I_{REF}$ (e.g., about 20 μA) is pulled through the resistor 232, a voltage drop is provided across the resistor such that the voltage across the resistor is added to the voltage across the capacitor 202 accordingly. For example, 20 μA of current through a 7 kΩ resistor 232 results in a voltage drop of about 0.14 volts that is added to the voltage of the capacitor 202.

As a result of the aggregate voltage associated with capacitor 202 and the resistor 232 exceeding the voltage across the capacitor 204, when the capacitors 202 and 204 are coupled through the switch system 212, the voltage across capacitor 204 is balanced with the aggregate voltage across capacitor 212 and resistor 232 (generally depending on the clock cycle). That is, the charge of the capacitor 204 increases due to its connection with the capacitor 202 through switching system 212. During the next part of the clock cycle, the switch system 214 is activated (and the switch system 212 is deactivated) so that the capacitor 204 pre-charges the capacitor 202 through the isolation system 218. Specifically, the logic system 210 provides signals to activate transistors 228 and 230 to connect the output of the isolation system 218 with the capacitor 202. The isolation system 218, for example, includes a unity gain amplifier that receives the voltage across the capacitor 204 as its input. Thus, the isolation system 218 provides a voltage to the capacitor 202 that is substantially equivalent to the voltage across the capacitor 204, while also providing current isolation between the capacitors so that capacitor 204 experiences no significant decrease in voltage.

Further, because the capacitor 204 has a greater capacitance than 202 (e.g., about an order or magnitude), the incremental step increases in the voltage of the capacitor 204 are small. Thus, it will be appreciated that smaller incremental voltage increases at the capacitor 204 can be achieved by modifying the capacitance ratio of the capacitors 202 and 204. In this way, during activation of the switch 212 current I1 also flows through the resistor 232 to impose a voltage potential that is added to the voltage across the capacitor 202. This combined voltage, which is larger than the initial voltage across the capacitor 204, operates to charge the capacitor 204 to a higher voltage, as described herein. It is to be appreciated that the capacitor 202 operates as a pump capacitor that can quickly charge and discharge, whereas the capacitor 204 operates as a storage capacitor (e.g., having a greater capacitance) that only charges, and in a slow manner.

The voltage at the node 226 operates as a control signal for gating an output transistor (e.g., an NMOS) 254 according to an aspect of the present invention. The transistor 254 thus provides the RAMP signal based on the voltage across the capacitor 204. For example, as the voltage at node 226 drops incrementally (e.g., due to its stepwise gradual charging of the capacitor 204), the transistor 254 is gated to decrease the amount of current through the transistor proportionately. That is, the transistor 254 operates as a variable resistance coupled in series with a resistor 256 between AVDD and ground in which its resistance varies as a function of the voltage across the capacitor 204. Specifically, the RAMP signal decrease as a function of the voltage at node 226. The RAMP signal corresponds to the voltage drop across the resistor 256, for example.

As a result of the configuration of the input logic 210 relative to the current source system 234 and switching systems 212 and 214, the soft start system 200 is operative to generate a desired RAMP signal in accordance with an aspect of the present invention. In the illustrated example, the RAMP voltage will slowly ramp from a starting voltage (e.g., about 1V below AVDD), such as when the voltage at 226 is high, down to an end voltage (e.g., a plateau) based on the control signal at 226 being insufficient to bias the output transistor on (e.g., less than about 2.6 V). The plateau, for example, corresponds a desired DC voltage (e.g., 1.56 V), which can be obtained by sourcing an appropriate current (e.g., 20 μA) at the output across the resistor 256 (e.g., 78 KΩ). As an alternative to sourcing current to achieve a desired plateau in the RAMP signal, the resistor 256 could be coupled between the transistor 254 and a fixed DC voltage source (not shown), which provides the ending "plateau" voltage for the RAMP signal during the soft-start cycle. Then after the voltage at 226 drops below another threshold (e.g., about 1.3 V), the isolation system 218 provides the END SOFT START signal to the control logic 210 to pull the node 226 to ground in accordance with an aspect of the present invention. This can be utilized to disable the soft start system to avoid pumping noise into the circuit normal operation. Those skilled in the art will understand and appreciate that such an approach can easily be adapted to provide a ramp up RAMP signal according to another aspect of the present invention.

Figure 5:
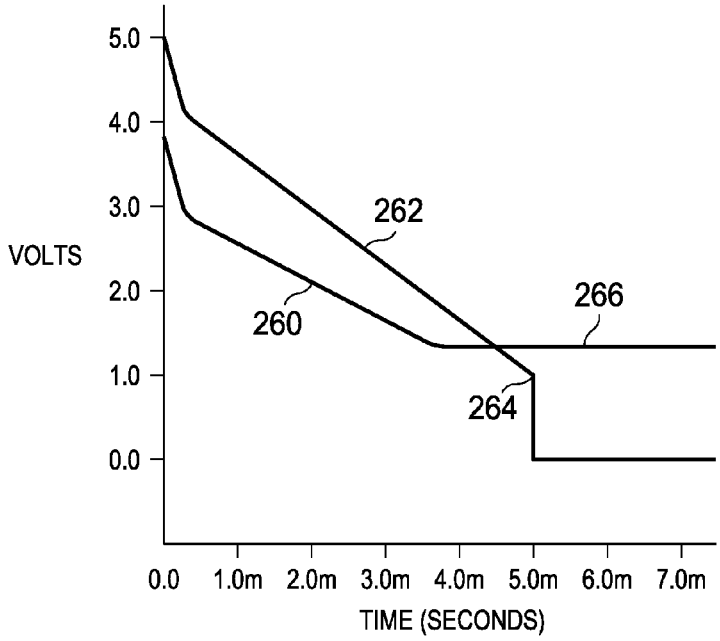
FIG. 5 is a graph depicting examples of a ramp signal and a ramp control signal generated in a soft start system in accordance with an aspect of the present invention.

FIG. 5 illustrates an example of time-based plots for a RAMP signal (depicted as a ramp down signal) 260 and a voltage signal 262, such as corresponding to the voltage at the node 226 applied to the gate of the output transistor 254 (FIG. 4). The signal 262, which is applied to the gate of the output transistor 254 starts at about 5 V and incrementally ramps downwardly to about 1.3 V. As described above, decreases in the signal 262 occur in generally discrete steps due to load balancing between respective capacitors through operation of a switching network. When the voltage signal 262 reaches about 1.3 V, indicated at 264, the soft start functionality ends and normal operation of the associated voltage regulator begins. The end of the soft start cycle 264 results in the control voltage of an associated output device being pulled low (e.g., to about 0 V) where it can remain until the soft start cycle begins again. At the same time the gate of the output transistor is pulled down, the signal END SOFT START (FIG. 4) disables the control logic 210. This ends the pumping activity which reduces the noise during normal operation.

The ramp voltage 260 follows the gate voltage 262. For example, it starts at a high voltage of about 3.8 volts and incrementally ramps downwardly with each clock cycle to a low voltage of about 1.56 V, where it plateaus (or levels off) to a fixed potential, indicated at 266. The plateau 266 can be implemented, for example, by supplying a predetermined DC current relative to the ramp output or by applying to the output circuitry a fixed DC voltage supply through a resistor. The incremental changes in each of the signals 260 and 262 occur commensurate with the clock cycles that provide a timing basis for the soft start system.

Figure 6A:
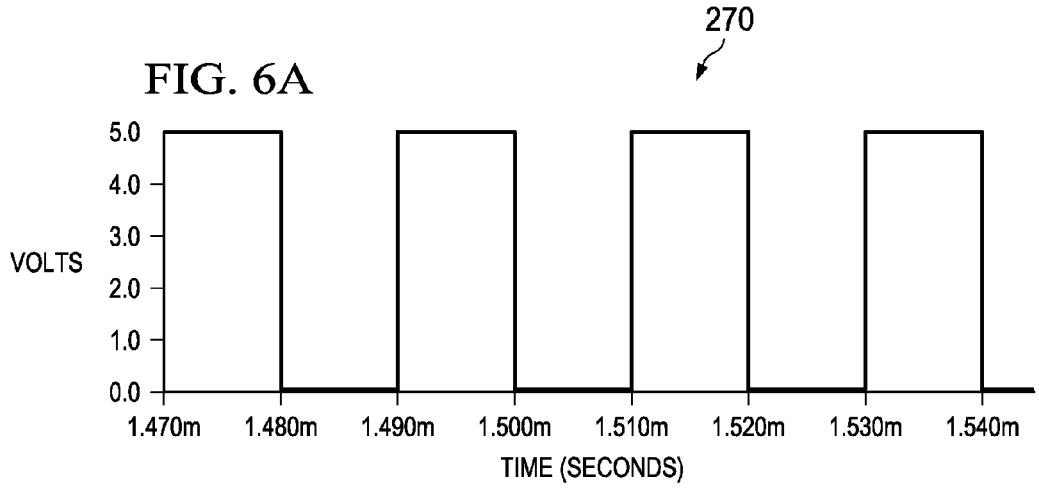
FIGS. 6A and 6B are graphs illustrating enlarged views of a clock signal and a ramp signal that of a soft start system in accordance with an aspect of the present invention.
Figure 6B:
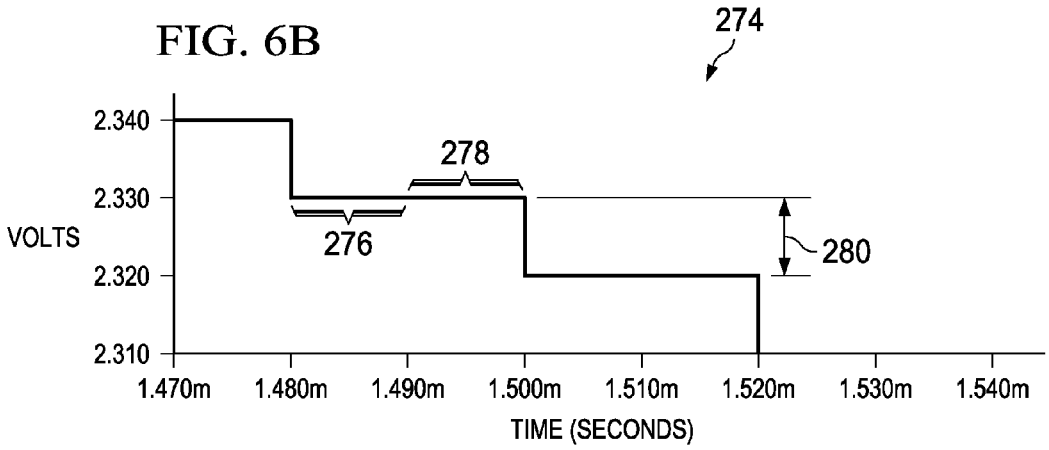

FIG. 6A illustrates an example a part of a clock (CLK) signal 270 that can be utilized to cycle the soft start system 200 according to an aspect of the present invention. For example, the clock cycle is a 50 kHz clock having a 50% duty cycle varying between 0 and 5 volts. FIG. 6B depicts part of the RAMP output signal 274 corresponding to the portion of the clock signal 270 illustrated in FIG. 6A (e.g., it has been enlarged relative to the RAMP signal 260 shown in FIG. 5).

To facilitate understanding operation of the soft start system 200 in FIG. 4, a portion of the RAMP signal 260, indicated at 276, corresponds to a condition when charge is transferred from the capacitor 202 to the capacitor 204, which occurs when the clock signal 260 is low, for example. Another portion 278 of the RAMP signal 274 corresponds to pre-charging of the capacitor 202 by the isolation system 218 based on the voltage at the capacitor 204, which occurs when the clock signal 270 is high, for example.

By way of further illustration and with reference between FIGS. 4, 6A and 6B, when the clock signal 270 is low (e.g., 0 V), for example, the switch system 212 is activated to an on condition to electrically couple the capacitor 202 to the capacitor 204. As a result, during this clock state, the capacitors 202 and 204 are connected together. Because voltage across the capacitor 204 is lower than the aggregate voltage across the capacitor 202 and the resistor 216, this coupling results in an increase in the voltage across 204. That is, the voltage across the capacitor 204 is forced to a voltage equal to about the voltage across the capacitor 202 plus the voltage across the resistor 232. The change in voltage also corresponds to a transfer of charge from the capacitor 202 to the capacitor 204, which results in the capacitor 202 having a smaller voltage after the charge transfer. Then, as the clock pulse goes high, the switch 212 is turned off and the switch 214 is activated to begin a pre-charging of the capacitor 202. In particular, activation of the switch 214 electrically couples the output of the isolation system 218 with the capacitor 202. By implementing a unity gain amplifier in the isolation system 218, the isolation system can output a voltage to the capacitor 202 that is substantially equal to the voltage across the capacitor 204, which results in pre-charging of the capacitor 202, indicated at 278. It will be appreciated that the voltage on the storage capacitor at node 226 and the RAMP do not change during pre-charging of the capacitor 202 by the isolation amplifier. Because the capacitor 204 operates as the input to the isolation system 218 (providing a high impedance at node 226), the charge of the capacitor 204 changes little (if at all) during the pre-charging at 278. Upon the clock signal 270 going low, the capacitor 202 is connected again to the capacitor 204. Because current also flows through the resistor 232 when the switch 212 is on, the connection of the capacitors through the switch results in a corresponding increase in voltage across the capacitor 204 and a decrease in the voltage at node 226. The decrease in voltage at the node 226 results in change in the RAMP signal, indicated at 280 in FIG. 6B.

In general, the isolation system 218 helps to ensure a high impedance node at 226 so as to provide current isolation between the respective capacitors 202 and 204 when pre-charging the capacitor 202. Additionally, during activation of the switch 214 (during cycle portion 278), it is noted that the current source 234 is controlled so that the current is not mirrored through the transistor 244. Instead, the transistor 242 is activated so that the current system 234 draws no current through the resistor 232. In this way, the pre-charging of the capacitor 202 to a voltage about equal to that across the capacitor 204 is facilitated during cycle portion 278. When the clock signal 270 is low, the current system 234 is again activated to mirror the current $I_{REF}$ through the transistor 244, drawing current to cause a voltage drop across the resistor 232, thereby adding a step voltage to the voltage across the capacitor 202. By repeating this cycle over several clock pulses, the voltage at the node 226 gradually ramps down in incremental steps, which controls the RAMP signal accordingly.

According to an aspect of the present invention, the incremental changes in the RAMP signal are facilitated because the capacitor 204 operates as a storage capacitor that is utilized to pre-charge the smaller capacitor (e.g., operating as pump capacitor) 202 before the next cycle starts. The pre-charging of the capacitor 202 is modified each cycle due to a small voltage step corresponding to the voltage drop across the resistor 232 that is added to the voltage across the capacitor 202. The change in voltage across the capacitor 202 plus the resistor 232, in turn, provides a small voltage step (e.g., related to the voltage across the capacitor 202 plus the resistor 232) that is transferred to the capacitor 204 during each clock cycle and thereby causes a corresponding decrease in the voltage at 226 that is used to gate the RAMP signal.

It is to be appreciated that while a single clock cycle has been employed in this example as a timing basis for transferring charge between the respective capacitors 202 and 204 those skilled in the art will understand and appreciate that other cyclical approaches (e.g., clock cycles of varying length and/or duty cycle) can be utilized to generate appropriate timing signals, all of which are contemplated as falling in the spirit and scope of the present invention.

Figure 7:
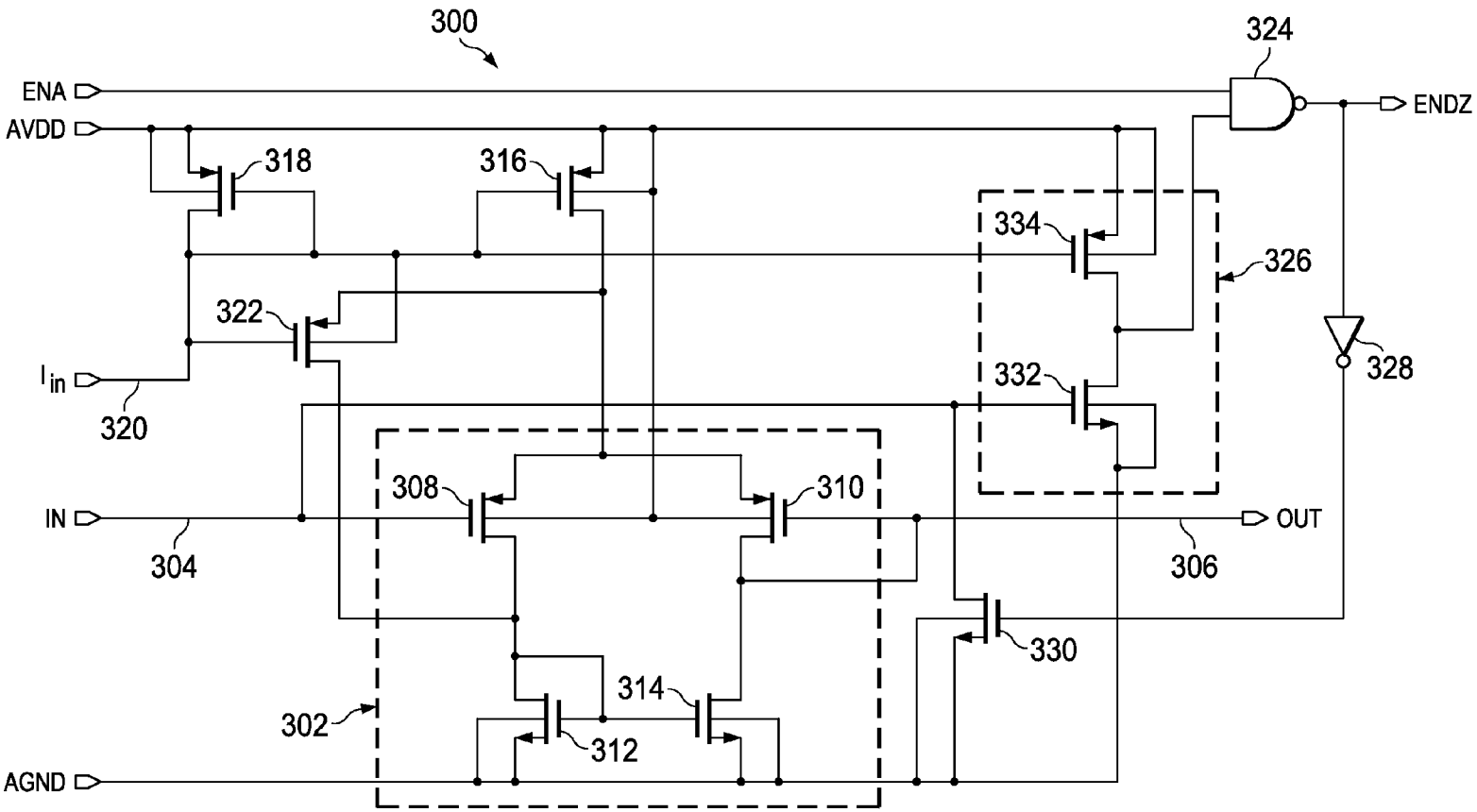
FIG. 7 is an example of an isolation system that can be utilized in a soft start system in accordance with an aspect of the present invention.

FIG. 7 illustrates an example of an isolation amplifier system 300 that can be utilized in a soft start system implemented in accordance with an aspect of the present invention. The amplifier system 300 includes a unity gain amplifier 302 connected between an input 304 and an output 306 of the amplifier system. For example, the input 304 can correspond to the node 226 (e.g., the gate voltage supplied to the output transistor 254) and the output 306 can be provided to the switch system 214 for coupling to the capacitor 202 in the circuit of FIG. 4. The amplifier 302 includes a differential pair of PMOS transistors 308 and 310 and a current mirror formed of NMOS transistors 312 and 314.

The pair of transistors 308 and 310 are connected to a fixed voltage (AVDD) through a transistor 316, which forms part of a current mirror with an associated transistor 318. The current mirror is driven by an input current $I_{in}$ provided to another input 320 of the amplifier system 300 (e.g., $I_{in}$ corresponding to current mirrored through the transistor 246 in FIG. 4). The amplifier current mirror (formed of transistors 312 and 314) further is coupled to the input current mirror (formed of transistors 316 and 318) through a coupling transistor 322. The transistor 322 thus forces current from the transistor 316 to the transistor 312 based on the voltage at 320, which current is mirrored to drive current through the transistor 314. The transistor 322 thus operates to provide an alternative path to provide a correct initial voltage at the output if the input voltage is high at start up.

Operation of the amplifier system 300 further is controlled based on an enable (ENA) signal provided to a NAND gate 324. The NAND gate also receives an input signal from circuitry 326 operative to detect the end of the soft start mode. The NAND gate 324 provides its output to an inverter 328, which output signal is provided to deactivate the associated soft start system. The ENDZ signal is provided to deactivate the associated soft start system, such as based on an output signal from the detection circuitry 326. The inverted output is provided to the gate of another transistor 330, which is coupled between the input 304 and ground. The transistor 330 operates to control operation of the amplifier system 300 based on the ENDZ signal.

The detection circuitry 326 includes an NMOS transistor 332 coupled in series with a PMOS transistor 334. A juncture between the transistors 332 and 334 defines the second input to the NAND gate 324, which juncture provides the output signal indicating whether the soft start mode has ended. The input 304 is coupled to the gate of the transistor 332. In a similar manner the PMOS transistor 334 is gated according to the voltage at 320. As a result, the output of the detection circuitry 326 will be normally low and will go high (e.g., about AVDD) when the voltage at 304 approaches a threshold voltage of about 1.3V.

In view of this arrangement, it is to be appreciated that the gate of the transistor 332 will be equal to the input provided at 304 so long as the transistor 330 is off. Thus, current flows through the transistor 332 while the input voltage is high (e.g., it exceeds the threshold about 1.3V) during the soft start mode. As described above, the input voltage at 304 begins at (or near) AVDD and ramps down due the cyclical transferring of electrical energy between the capacitors in accordance with an aspect of the present invention. Accordingly, once the input voltage gets sufficiently low so that the transistor 332 is no longer sufficiently biased, the output of the detection circuitry 326 changes from low to high. When the output changes from low to high, the ENDZ signal changes states from logic high to logic low and, in turn, activate the transistor 330, pulling the input voltage at 304 to ground (see, e.g., 264 in FIG. 5).

Figure 8:
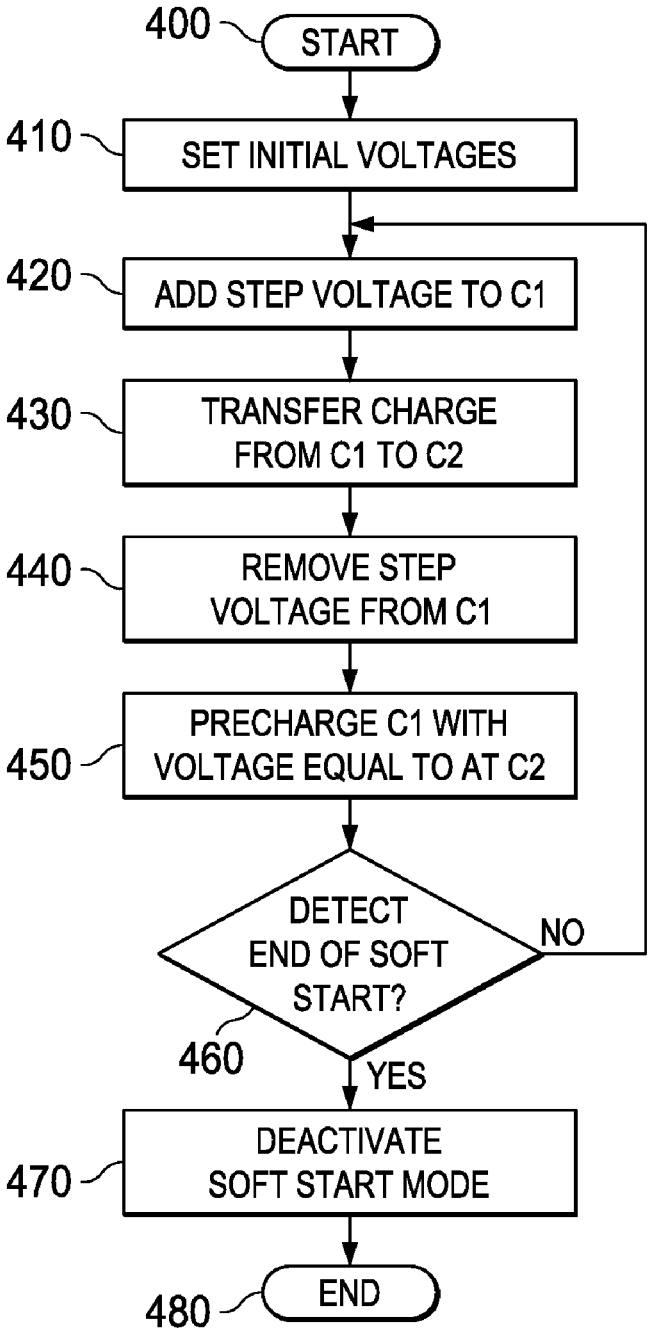
FIG. 8 is a flow diagram illustrating a methodology for generating a ramp signal in accordance with an aspect of the present invention.

In view of the foregoing structural and functional features described above, a methodology for generating a ramp (e.g., up or down) signal, in accordance with an aspect of the present invention, will be better appreciated with reference to FIG. 8. While, for purposes of simplicity of explanation, the methodology of FIG. 8 is shown and described as being implemented serially, it is to be understood and appreciated that the present invention is not limited to the illustrated order, as some aspects could, in accordance with the present invention, occur in different orders and/or concurrently with other aspects from that shown and described. Moreover, not all illustrated features may be required to implement a methodology in accordance with an aspect of the present invention. It is to be further understood that the following methodologies can be implemented in hardware, integrated circuits, software, or any combination thereof.

Turning to FIG. 8, the methodology begins at 400, such as in conjunction with powering up an associated voltage regulator that incorporates a soft start system in accordance with an aspect of the present invention. Next at 410, initial voltages for a pair of capacitors C1 and C2 are set (e.g., zero volts).

At 420, a voltage step is added relative to the voltage across C1. For example, a predetermined current can be driven through a resistor to generate a voltage potential, which can be used to provide a corresponding incremental increase in the voltage associated with C1. Then, at 430, a portion of the charge is transferred from C1 to C2. The transfer can occur by coupling C1 and C2 together (e.g., through a switch network) to substantially evenly redistribute the voltages between the capacitors. In particular, where the voltage across C1 plus the step voltage provided at 420 are greater than the voltage across C2, the voltage across C2 will increase accordingly.

Next, at 440 the step voltage provided at 420 is removed. This can occur, for example, by deactivating a biasing current source that supplies the current that causes the additional voltage across the resistor. At 450, C1 is pre-charged by duplicating the voltage of C2 to charge C1. For example, the voltage duplication from C2 and C1 can be implemented by employing the voltage across C2 as an input to an amplifier (e.g., a unity gain amplifier) that can, in turn, provide substantially the same (e.g., the duplicate) voltage as across C2 to pre-charge C1. The pre-charging of C1 (as well as the incremental charging of C2 at 430) can be facilitated by providing C2 with a greater capacitance, such as about an order of magnitude larger, than C1.

At 460, a determination is made as to whether the soft start cycle has ended. The determination can be made, for example, based on a voltage related to the ramping signal (e.g., a control signal provided to an output transistor) or based on the ramping signal itself. If the determination is negative, indicating an end for the soft start cycle has not been detected, the methodology returns to 420 and the foregoing methodology can continue, generally repeating 420-460 from its new state. If the end has been detected at 460, however, the methodology proceeds to 470. At 470, the soft start mode can be deactivated, such as by disabling associated circuitry. For example, at 470, a voltage regulator implementing such methodology can enter its normal operating mode to provide a desired voltage to an associated circuitry or load. From 470, the soft start methodology proceeds to 480 in which it ends.

What has been described above are examples of the present invention. It is, of course, not possible to describe every conceivable combination of components or methodologies for purposes of describing the present invention, but one of ordinary skill in the art will recognize that many further combinations and permutations of the present invention are possible. For example, while much of the soft-start approach has been described herein in connection with causing storage and pump capacitors voltages to increase, it will be appreciated that different styles of ramp up or ramp down systems can be created in accordance with an aspect of the present invention, such as by choosing the reference voltages and appropriate circuit components according to the style being implemented. In some cases, it further may be appropriate (or necessary) to pre-charge the storage capacitor to effect a desired change (e.g., a decrease) in the pump capacitor voltage. Accordingly, the present invention is intended to embrace all such alterations, modifications and variations that fall within the spirit and scope of the appended claims.

What is claimed is:

1. A soft start system, comprising:

a first energy storage device coupled to a reference node;

a second energy storage device coupled between the reference node and an output so as to provide an output signal at the output based on a charge stored in the second storage device; and a switch system electrically coupled between the first and second energy storage devices, the switch system being operative to enable a change in the charge stored in the second storage device during a first part of a cycle and to enable the first energy storage device to be pre-charged based on the charge of the second energy storage device during a second part of the cycle, such that the output signal incrementally changes from a starting level to an ending level.

2. The system of claim 1, the switch system further comprising a pair of switch devices electrically coupled in parallel between the first energy storage device and the output.

3. The system of claim 2, further comprising an isolation amplifier coupled between the first and second energy storage devices along a path that includes a first of the pair of switch devices, the isolation amplifier operating supplying voltage to the first energy storage device based on a voltage associated with the second storage device when connected by the first switch device to facilitate the pre-charging the first energy storage device.

4. The system of claim 2, further comprising a clock generator that generates a clock pulse that defines an input signal that controls the cycle, the clock pulse operating each of the pair of switch devices mutually exclusively so as to control a direction of energy transfer relative to the first and second energy storage devices.

5. The system of claim 1, the first and second energy storage devices comprising respective first and second capacitors.

6. The system of claim 5, the first capacitor having a capacitance that is less than the second capacitor.

7. The system of claim 6, the first capacitor having a capacitance that is about an order of magnitude less than the second capacitor.

8. The system of claim 1, further comprising a circuit that applies a voltage step to the first energy storage device during the first part of the cycle to provide an aggregate voltage, the switch system enabling the aggregate voltage to be applied to the second energy storage device so as to cause a corresponding change in a voltage associated with the second energy storage device, such that the output signal varies based on the change in the voltage associated with the second energy storage device.

9. The system of claim 8, further comprising a resistor coupled between the first storage device and the reference node; and a current source coupled to a juncture between the first energy storage device and the resistor, the current source providing current relative to the juncture to cause a corresponding voltage drop across the resistor that is added to a voltage associated with the first energy storage device to provide the aggregate voltage.

10. The system of claim 1, further comprising an output circuit that provides a ramp signal that varies based on the output signal.

11. The system of claim 10, the output circuit further comprising a transistor having a control input that receives the output signal and operates to provide the ramp signal based on the output signal.

12. The system of claim 11, further comprising an output resistor coupled to the output transistor, the output transistor coupled between the reference node and the output resistor, such that the ramp signal varies based on a voltage potential across the output resistor.

13. A voltage regulator system incorporating the soft start system of claim 1.

14. A soft start system, comprising:

a first capacitor coupled to a reference voltage;

a second capacitor coupled between the reference voltage and an output, an output signal at the output varying based on a voltage associated with the second capacitor;

circuitry coupled to the first capacitor operative to provide a voltage during a first part of the cycle that is aggregated with a voltage of the first capacitor; and a switch system electrically coupled between the output and the first capacitor, the switch system operative to connect the first and second capacitors during the first part of a cycle to cause the voltage associated with the second capacitor to change based on the aggregated voltage, and operative to connect a voltage to pre-charge the first capacitor based on the voltage associated with the second capacitor during a second part of the cycle.

15. The system of claim 14, the switch system further comprising a pair of switch devices connected in parallel between the first capacitor and the output, during the first part of the cycle, a first of the switch devices connecting the first and second capacitors and, during the second part of the cycle, a second of the switch devices connecting the voltage to pre-charge the first capacitor to a voltage that is functionally related to the voltage associated with the second capacitor.

16. The system of claim 15, further comprising an isolation system coupled between the first and second capacitors along a path that includes the second switch device to provide current isolation from the second capacitor to the first capacitor when connected by the second switch device, thereby facilitating pre-charging the first capacitor without substantially discharging the second capacitor.

17. The system of claim 15, the pair of switches operating between first and second conditions substantially mutually exclusively based on a clock pulse so as to control connections between the first and second capacitors during the first and second parts of the cycle.

18. The system of claim 14, the first capacitor having a capacitance that is less than the second capacitance.

19. The system of claim 14, the circuitry further comprising a resistor coupled between the first capacitor and the reference voltage; and a current system coupled to a juncture between the first capacitor and the resistor, the current system providing current relative to the juncture to cause a corresponding voltage drop across the resistor that is added to a voltage associated with the first energy storage device to provide the aggregated voltage.

20. The system of claim 14, further comprising an output circuit that provides a ramp signal that varies based on the output signal.

21. The system of claim 20, the output circuit further comprising:

a transistor having a control input that receives the output signal, and an output resistor coupled to the output transistor so that the ramp signal varies based on a voltage potential across the output resistor.

22. A soft start system, comprising:

first means for storing electrical energy;

second means for storing electrical energy;

means for connecting the first and second energy storing means during a first part of a cycle to cause an incremental change in the electrical energy stored in the second energy storing means;

means for pre-charging the first energy storing means during a second part of the cycle based on the electrical energy stored in the second energy storing means;

means for controlling each of the means for connecting over a plurality of cycles; and means for providing a ramp output signal based on the electrical energy stored in the second energy storing means based on the incremental change in the electrical energy stored in the second energy storing means.

23. A method for providing a soft start signal, comprising:

connecting a pair of energy storage devices during a first part of a cycle to cause an incremental change in the voltage associated with a first of the energy storage device;

pre-charging the second energy storage device with a pre-charge voltage based on the voltage associated with the first energy storage device during a second part of the cycle;

repeating the connecting and pre-charging during respective first and second parts of a plurality of cycles to cause corresponding incremental changes in the voltage associated with the first energy storage device over the plurality of cycles; and providing a ramp signal based on the voltage associated with the first energy storage device.

24. The method of claim 23, further comprising generating the pre-charge voltage to be substantially equal to the voltage associated with the first of the energy storage device, while electrically isolating current from the first energy storage device to the second energy storage device.

25. The method of claim 23, the connecting and pre-charging during the respective first and second parts of the cycle occurring substantially mutually exclusively based on a timing signal.

26. The method of claim 23, the first and second energy storage devices comprising respective first and second capacitors, the second capacitor having a capacitance that is less than the first capacitor.

27. The method of claim 23, further comprising adding a step voltage to the voltage associated with the second energy storage device during the first part of the cycle, such that the step voltage plus the voltage associated with the second energy storage device are supplied to the first energy storage device to cause the incremental change in the voltage associated with the first energy storage device.

* * * * *